US006269825B1

(12) United States Patent
Yager

(10) Patent No.: US 6,269,825 B1
(45) Date of Patent: Aug. 7, 2001

(54) TENT POLE GROUND ANCHOR AND SUPPORT DEVICE AND METHOD OF USING SAME

(76) Inventor: Ronald L. Yager, 304 E. Central, Richmond, KS (US) 66080

( * ) Notice: Subject to any disclaimer, the term of this patent is extended or adjusted under 35 U.S.C. 154(b) by 0 days.

(21) Appl. No.: 09/494,888

(22) Filed: Jan. 31, 2000

(51) Int. Cl.[7] ..... E04H 15/32; E04H 15/62

(52) U.S. Cl. ..... 135/120.1; 135/118; 248/508; 248/530

(58) Field of Search ..... 135/118, 119, 135/120.1, 120.2, 120.3, 114, 116, 121, 909; 248/508, 499, 530; 256/64; 52/155, 165

(56) References Cited

U.S. PATENT DOCUMENTS

| | | | | |
|---|---|---|---|---|
| 224,200 | | 2/1880 | Mayer . | |
| 2,185,629 | | 1/1940 | Dixon . | |
| 2,922,653 | | 1/1960 | O'Brien . | |
| 2,928,405 | | 3/1960 | Lawson . | |
| 3,957,069 | * | 5/1976 | Denaro | 135/15 |
| 4,148,332 | * | 4/1979 | Huddle | 135/4 |
| 4,343,449 | * | 8/1982 | Osthus | 248/156 |
| 4,782,846 | | 11/1988 | Ting . | |
| 5,740,827 | * | 4/1998 | Swarringim | 135/118 |

* cited by examiner

*Primary Examiner*—Christopher T. Kent
*Assistant Examiner*—Jennifer I. Thissell
(74) *Attorney, Agent, or Firm*—Hovey, Williams, Timmons & Collins

(57) ABSTRACT

A tent pole ground anchor and support device is disclosed as including a substantially flat base that is configured for placement on the ground. A pair of stake-receiving openings are defined in the base so that a ground stake may be inserted through one of the openings and into the ground. A wall projects upwardly from the base, with the wall and base cooperatively defining a pole-retaining recess that is configured to receive an end of the tent pole therein. With respect to known recreational tents, the recess is oversized relative to the tent pole so that the pole may be retained in the recess in the desired oblique orientation relative to the ground. The wall is preferably discontinuous and consequently presents spaced apart ends that cooperatively define a pole-receiving hole therebetween. The pole-receiving hole is provided so that the tent pole may be nested therein when in the desired orientation. To further retain the pole in the desired orientation, the wall includes a tall section across from the pole-receiving hole, whereby the end of the pole is less likely to disengage the wall when the pole is obliquely oriented.

15 Claims, 2 Drawing Sheets

TENT POLE GROUND ANCHOR AND SUPPORT DEVICE AND METHOD OF USING SAME

BACKGROUND OF THE INVENTION

1. Field of the Invention

The present invention relates generally to tents having structural poles and, more particularly, to a device that serves to securely support the pole on the ground so that the pole is maintained in the desired support orientation regardless of weather and ground conditions. The invention also pertains to a method of securely anchoring and supporting a tent pole on the ground.

2. Discussion of Prior Art

A problem often confronted by a person utilizing a collapsible tent is keeping the tent in the expanded, useable condition. Particularly, there is often difficulty in preventing the tent poles from shifting or falling from their desired support orientation. It is believed that this is primarily attributable to poor ground conditions (e.g., loose soil, solid rock, etc.) and/or weather conditions (e.g., windy or rainy conditions) which permit or cause the end of the pole placed on the ground to shift out of its original location. In any case, when a tent pole becomes dislodged from the desired support orientation, the tent will likely collapse and possibly blow away. In wet conditions, the contents of the tent are consequently susceptible to becoming wet. It will be appreciated that this problem also creates a nuisance and hassle for the camper, as the tent must be repeatedly erected.

OBJECTS AND SUMMARY OF THE INVENTION

Responsive to these and other problems, an important object of the present invention is to reduce the risk of a tent collapsing caused by dislodgement of the tent pole(s) from the desired support orientation. That is to say, an important object of the present invention is to provide a system that essentially ensures that the tent pole(s) remain in the desired support orientation regardless of weather and ground conditions. It is particularly an important object of the present invention to provide a device that securely anchors and supports the lower end of a tent pole on the ground. It is also an important object of the present invention to provide a tent pole ground anchor and support device that is capable of being used with virtually every known commercially available tentpole. Yet another important object of the present invention is to provide a tent pole ground anchor and support device that has a durable yet inexpensive construction.

In accordance with these and other objects evident from the following description of the preferred embodiment, the present invention concerns a tent pole ground anchor and support device comprising a unitary body that includes a lower face configured for placement on the ground. A stake-receiving opening extends through the body so that the device may be securely anchored on the ground by inserting a ground stake through the opening and into the ground. The body further includes a pole-retaining recess that is cooperatively defined by a floor and an upright surface. The surface includes an opening that is configured to receive at least a portion of the pole when the pole is placed in an oblique orientation relative to the upright axis about which the recess is defined. The pole may consequently be "nested" within the hole and thereby further retained in the desired support orientation.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 1:
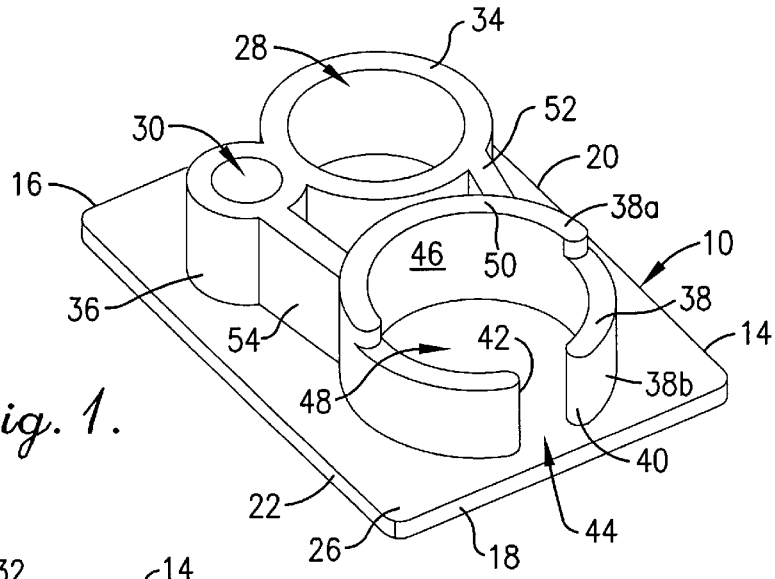
FIG. 1 is a perspective view of a tent pole ground anchor and support device constructed in accordance with the principles of the present invention.
Figure 2:
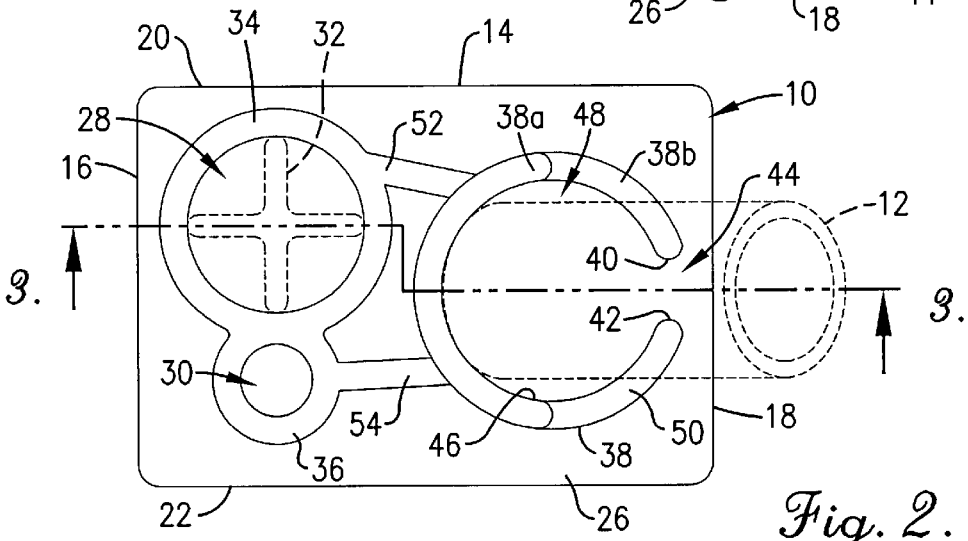
FIG. 2 is a top plan view of the device, particularly illustrating in phantom a ground stake inserted into the large stake-receiving opening and a tent pole retained within the pole-retaining sleeve.
Figure 3:
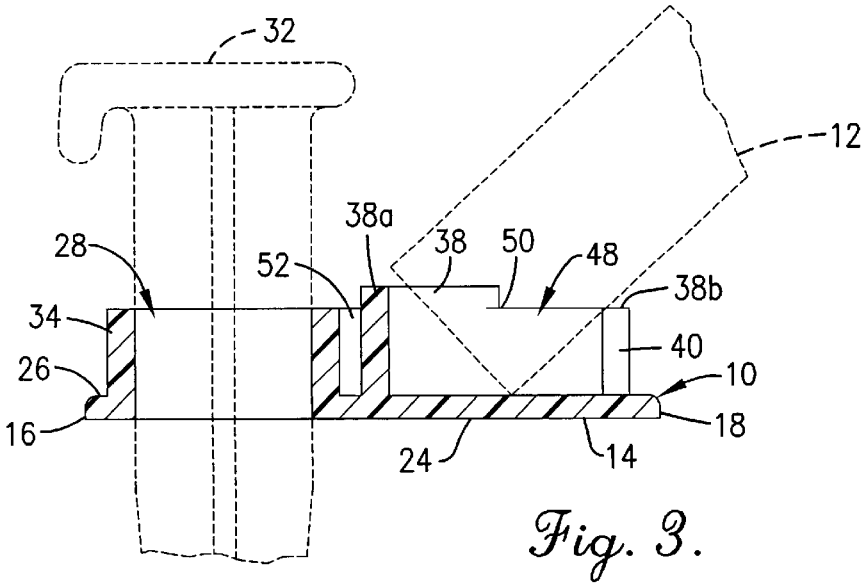
FIG. 3 is a vertical cross-sectional view of the device taken along line 3—3 of FIG. 2.

Turning initially to FIG. 1, the tent pole ground anchor and support device 10 selected for illustration is designed for use with virtually every known recreational tent pole currently available in the retail market. Traditionally, recreational tents are collapsible and include a set of tent poles 12 (only one of the poles being shown in the drawing figures) to keep the tent in the expanded, useable condition. In most cases, a number of the poles are obliquely oriented on the ground to support the tent in the expanded condition, as shown in FIGS. 2 and 3. However, such orientation of the poles 12 is often made difficult by weather and ground conditions. For example, high winds might cause the lower end of the pole 12 to shift along the ground such that the pole eventually falls from the desired, oblique support orientation. It is also possible for the end of the pole 12 in loose soil conditions to progressively penetrate the ground, which will likely lead to the same untoward result. The inventive device 10 addresses the difficulty in maintaining the tent pole 12 in the desired support orientation by preventing the tent pole 12 from penetrating the ground and by retaining the tent pole 12 in a fixed location and orientation.

Particularly, the illustrated device 10 includes a base 14 comprising a rectangular, generally flat plate. The base 14 presents parallel opposite ends 16,18 and parallel sides 20,22 extending between the ends, with the corners of the base preferably being rounded. The base 14 further presents a flat lower face 24 configured for placement on the ground and a parallel flat upper face 26. The preferred base 14 has an end dimension of approximately two and one-quarter inches and a side dimension of approximately three and one-quarter inches. However, the principles of the present invention are equally applicable to various other base sizes and shapes. It is only critical that the base 14 provide a floor upon which the end of the tent pole 12 is supported, as is subsequently described.

A pair of stake-receiving openings extend through the base 14 from the lower face 24 to the upper face 26. As perhaps best shown in FIG. 2, the illustrated openings 28 and 30 both have circular cross-sectional shapes but are different in size. Particularly, the diameter of the larger opening 28 is more than two times greater than the diameter of the smaller opening 30. It is in entirely within the ambit of the present invention to provide the base 14 with more or less stake-receiving openings than that shown in the illustrated embodiment. Furthermore, the stake-receiving openings provided in the base 14 may be variously shaped and sized (e.g., the opening(s) may be configured for use with a specific polygonal shaped stake, with the opening having a polygonal shape to match that of the stake).

The illustrated stake-receiving openings 28 and 30 preferably have about three-eighths of an inch and one inch diameters, respectively. It has been unexpectedly determined that these preferred dimensions assure that the device 10 is securely anchored to the ground regardless of the type of traditional tent ground stake being used. It is particularly believed that virtually all traditional ground stakes used with recreational tents have cross-sectional dimensions ranging between one-eighth of an inch and one inch. In this regard, tent stakes having a cross-sectional dimension less than the diameter of the smaller opening 30 are inserted through the smaller opening 30, whereby shifting of the device 10 relative to the stake is restricted to a greater degree than if the small stake had been inserted through the large opening 28. Of course, those stakes having a cross-sectional dimension greater than the diameter of the small opening 30 (such as the ground stake 32 shown in FIGS. 2 and 3) must be inserted through the large opening 28. It may consequently be said that the multiple, different sized openings 28,30 defined in the base 14 ensure that any type of ground stake may be "snugly" received in a corresponding one of the openings to provide the greatest limitation to movement of the device 10 relative to the stake and thereby the ground.

In the embodiment shown in FIGS. 1–3, a pair of upright walls 34 and 36 project normally from the upper face 26 of the base 14, with each of the walls 34 and 36 being in a circumscribing relationship with a respective one of the openings 28 and 30. The walls 34 and 36 preferably intersect to cooperatively form a "figure 8", which is believed to enhance the rigidity of the walls 34 and 36 as well as the device 10. It is noted that the cylindrical shape of the walls 34 and 36 corresponds with the cross-sectional shape of the openings, although it is entirely within the ambit of the present invention to provide other variously shaped and sized projections extending partly or completely about the openings 28 and 30.

Spaced from the stake-receiving openings 28,30 is a third upright wall 38 which, in the illustrated embodiment, has a circular cross-sectional shape (see FIG. 2) and is discontinuous in the sense that the wall is broken to present opposed ends 40 and 42 defining a hole 44 therebetween. In other words, the wall 38 is generally C-shaped. The interior face 46 of the wall 38 cooperates with the upper face 26 of the base 14 to define an upright recess 48 in which the tent pole 12 is inserted and retained. The illustrated recess 48 has a circular cross-sectional shape, with the upright axis of recess being the center of the circle. However, the recess 48 can have virtually any cross-sectional shape (e.g., a square, star, etc.) and the recess axis need not be perpendicular to the floor (i.e., the upper face 26 of the base 14) as illustrated.

The floor of the recess 48 prevents the end of the tent pole 12 from penetrating the ground, and the upright wall 38 of the recess 48 restricts lateral movement of the pole 12 relative to the base 14 (and therefore the ground when the ground stake 32 is inserted through the base 14 and into the ground). With particular respect to the upright wall 38, the hole 44 is provided so that a portion of the pole 12 may be nested therein when in the oblique support orientation, as perhaps best illustrated in FIG. 3. That is, the hole 44 receives a portion of the pole 12 with the ends 40 and 42 of the wall 38 capturing that portion of the pole 12 therebetween, whereby lateral shifting of the pole 12 relative to the base 14 is further restricted. It is noted that the illustrated hole 44 extends the entire height of the wall 38, although the principles of the present invention are equally applicable to various other hole arrangements (e.g., a hole that extends only partly down the wall 38, an entirely enclosed hole, etc.).

Furthermore, the wall 38 presents a stepped top edge 50 such that one wall section 38*a* is taller than the other wall section 38*b*. The tall wall section 38*a* preferably extends around approximately one-half of the circle about which the wall 38 is defined, and the hole 44 being defined in the short wall section 38*b*. It may therefore be said that the hole 44 is diametrically opposite from the tall wall section 38*a*. When a tent pole is oriented obliquely within the recess 48 so as to engage the wall section 38*a*, the end of the tent pole is less likely to work its way up and eventually off of the wall 38.

It has been determined that certain recess and wall dimensions permit the device 10 to be used with virtually every known commercially available tent pole.

In particular, the recess 48 preferably has a diameter of between about one inch and one and one-quarter inches. Because the vertical tent pole (not shown) often used in a socalled "wall tent" (also not shown) will commonly have a diameter of approximately one and one-quarter inches, the recess diameter is most preferably one and one-quarter inches or slightly larger. Furthermore, as a result of the preferred manufacturing process (injection molding) of the device 10, the interior face 46 of the upright wall 38 may have a slight taper to facilitate removal of the molded part from the mold. The recess diameter may consequently be very close to the preferred dimension adjacent the base 14 and then gradually and slightly increase as the top edge 50 of the wall 38 is approached. In addition, the preferred device 10 has a tall wall section 38*a* with a vertical dimension of about five-eighths of an inch and a short section 38*b* with a vertical dimension of about one-half of an inch. These dimensions correspond with a recess that is capable of retaining obliquely oriented poles having diameters ranging between one-quarter of an inch and one inch. To accommodate the greatest number of variously sized, obliquely oriented tent poles, the ends 40 and 42 of the wall 38 are most preferably spaced apart about three-eighths of an inch.

A pair of reinforcing ribs 52 and 54 project upwardly from the upper face 26 of the base 14 and interconnect the recess-defining wall 38 and respective ones of the walls 34 and 36. The ribs 52 and 54 preferably have a vertical dimension equal to the short section 38*b* of the recess-defining wall 38. Those ordinarily skilled in the art will appreciate that the ribs 52 and 54 add strength and rigidity to the device 10. It is further noted that the stake-receiving openings 28,30 and the pole-retaining recess 48 are located generally on opposite sides of the center of the base 14, with the tent pole 12 preferably being angled downwardly toward the openings 28,30. It is believed that such a relationship further enhances the support and anchor functions of the device 10.

The device 10 comprises a unitary body that is preferably formed of a plastic material having beneficial cold weather resistant qualities. In other words, the material preferably used to form the device will not become brittle nor be susceptible to cracking when exposed to cold weather conditions (e.g., temperatures below 32° Fahrenheit). One suitable material that is particularly effective in injection molding techniques is polypropylene. However, it has also been determined that other suitable materials may be used, such as a polyethylene and elastic vinyl acetate blend. Although the body could also be formed of other materials (e.g., wood, metal, etc.), plastic is most preferred because of the low material and manufacturing cost normally associated therewith.

The use and operation of the device 10 should be apparent from the foregoing description. It shall therefore be sufficient to explain that the end of the tent pole 12 is inserted into the pole-retaining recess 48, as shown in the drawing figures. This will likely occur after the tent pole 12 has been suitably attached to the tent canvas (not shown). Furthermore, when the tent pole 12 is obliquely oriented relative to the upright axis of the recess 48, the pole 12 and device 10 are arranged so that the pole 21 angles downwardly toward the tall section 38*a* of the wall 38 and is at least partly received in the hole 44. The device 10 is placed in the proper location on the ground either before or after the tent pole 12 is inserted into the recess 48, whichever is preferred. The ground stake 32 is inserted through the corresponding stake-receiving opening 28 and into the ground (which may require a hammer) once the device 10 is properly located. Insertion of the ground stake 32 may also occur either before or after the step of inserting the tent pole 12 into the recess 48, although the ground stake 32 is most preferably driven into the ground after this step. It will be appreciated that a single tent may have multiple tent poles that engage the ground and each of the poles is preferably supported and anchored on the ground by a device 10.

Figure 4:
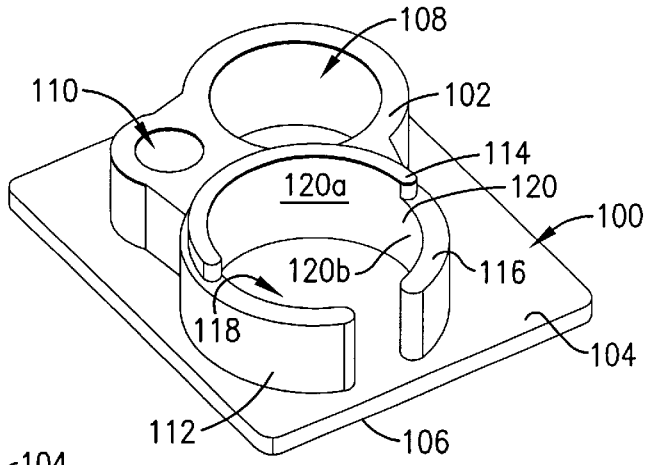
FIG. 4 is a perspective view of an alternative embodiment of the present invention.
Figure 5:
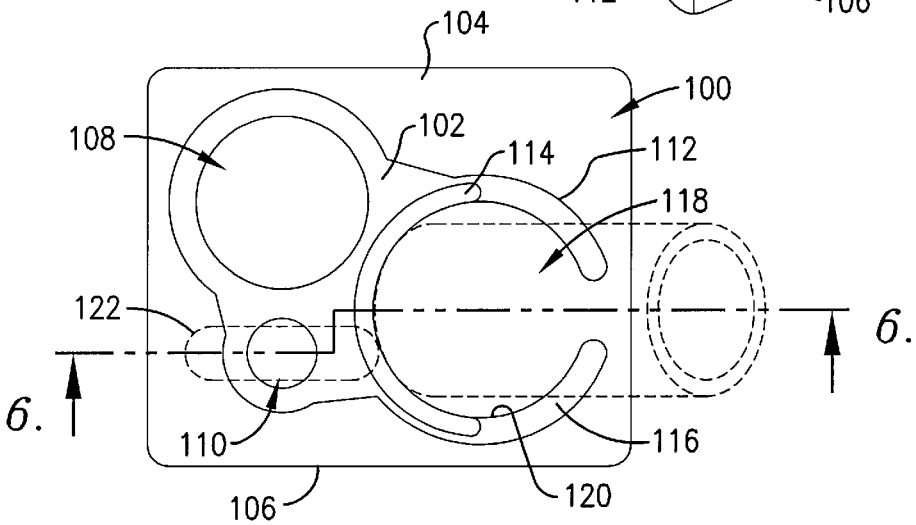
FIG. 5 is a top plan view of the alternative embodiment, particularly illustrating in phantom a ground stake inserted into the small stake-receiving opening and a tent pole retained within the pole-retaining sleeve.
Figure 6:
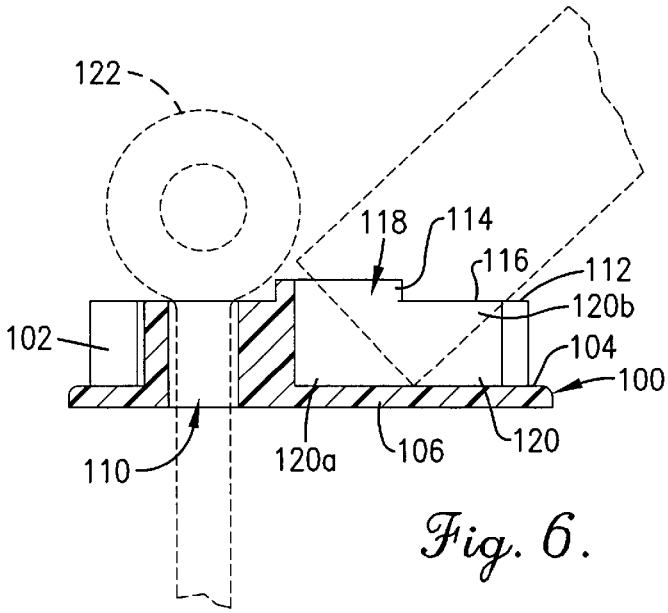
FIG. 6 is a vertical cross-sectional view of the alternative embodiment taken along line 6—6 of FIG. 5.

An alternative embodiment of the present invention is shown in FIGS. 4–6, wherein the illustrated tent pole ground anchor and support device 100 is very similar to that shown in FIGS. 1–3. However, the device 100 is different in that a boss 102 projects upwardly from the upper face 104 of the base 106. The boss 102 extends around the stake-receiving openings 108,110 and is integral with the recess-defining wall 112 (in essence, the boss 102 and wall 112 are one integral part of the device 100). A relatively thin, elongated lug 114 projects from the top edge 116 of the wall 112 about approximately half of the circumference of the recess 118. The lug 114 causes the interior surface 120 to have the desired tall and short sections 120*a* and 120*b* (see FIG. 6). It is also noted that the embodiment shown in FIGS. 4–6 is depicted in use with a different, relatively smaller ground stake 122 than that shown in FIGS. 2 and 3. Notwithstanding the above-noted distinctions, the tent pole ground anchor and support device 100 is used in the same manner as the first embodiment.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A tent pole ground anchor and support device for supporting and anchoring a tent pole on the ground, said device comprising:

a unitary body including:

lower face configured for placement on the ground, a stake-receiving opening extending through the body and projecting from the lower face so that a ground stake may be inserted through the base and into the ground, and a floor and an upright surface that cooperatively define an open top, pole-retaining recess defined about an upright axis, said upright surface having a side pole-receiving hole defined therein, with the pole-receiving hole being configured to receive at least a portion of the pole when the pole is oriented in the pole-retaining recess at an oblique angle relative to the upright axis of the recess.

2. A tent pole ground anchor and support device as claimed in claim 1, said body including a substantially flat base that defines the lower face and presents an upper face, said upper face defining the floor.

3. A tent pole ground anchor and support device as claimed in claim 2, said body including an upright wall projecting from the upper face of the base and presenting an interior face that defines the upright surface.

4. A tent pole ground anchor and support device as claimed in claim 2, said body including a projection extending upwardly from the upper face in a circumscribing relationship with the stake-receiving opening such that the opening extends through the projection.

5. A tent pole ground anchor and support device as claimed in claim 4, said projection comprising a boss that is integral with the upright surface.

6. A tent pole ground anchor and support device as claimed in claim 4, said body including a first upright wall projecting from the upper face of the base and presenting an interior face that defines the upright surface, said projection comprising a second upright wall that is spaced from the first upright wall, said body including at least one reinforcing rib projecting upwardly from the upper face and interconnecting the upright walls.

7. A tent pole ground anchor and support device as claimed in claim 1, said upright surface being generally cylindrical in shape and having a diameter between about one inch and one and one-quarter inches.

8. A tent pole ground anchor and support device as claimed in claim 1, said body including a second stake-receiving opening that extends through the body and projects from the lower face, said second stake-receiving opening being spaced from and having a relatively smaller cross-sectional area than the first-mentioned stake-receiving opening.

9. A tent pole ground anchor and support device as claimed in claim 1, said upright surface including opposite relatively tall and short sections, wherein the tall section has a vertical dimension relative to the floor that is greater than that of the short section, said pole-receiving hole being defined in the short section at a location spaced across the pole-retaining recess from the tall section.

10. A tent pole ground anchor and support device as claimed in claim 7, said upright surface presenting an uppermost top edge, said pole-receiving hole projecting downwardly from the top edge of the upright surface.

11. A tent pole ground anchor and support device as claimed in claim 1, said body being formed of plastic material having cold weather resistant qualities.

12. A tent pole ground anchor and support device for supporting and anchoring a tent pole on the ground, said device comprising:

a unitary body including a substantially flat lower face configured for placement on the ground, a stake-receiving opening extending through the body and projecting from the lower face so that a ground stake may be inserted through the base and into the ground, and a floor and an upright surface that cooperatively define a relatively oversized, open top pole-retaining recess that is configured to receive the tent pole in an oblique orientation relative to the lower face, said upright surface including opposite relatively tall and short sections, wherein the tall section has a vertical dimension relative to the floor that is greater than that of the short section.

13. A method of supporting and anchoring a tent pole on the ground, said method comprising the steps of:

(a) placing a tent pole ground anchor and support device on the ground;

(b) driving a ground stake through a stake-receiving opening defined in the device and into the ground; and (c) inserting an end of the tent pole into a relatively oversized, open top pole-retaining recess presented by the device and orienting the pole at an oblique angle relative to an upright axis about which the recess is defined.

14. A method of supporting and anchoring a tent pole on the ground as claimed in claim 13, wherein step (c) occurs before step (b).

15. A method of supporting and anchoring a tent pole on the ground as claimed in claim 11, wherein step (c) includes the step of placing at least a portion of the pole in a pole-receiving hole located in an upright surface that defines in part the pole-retaining recess.

* * * * *